United States Patent [19]

Takagaki

[11] Patent Number: 4,598,533

[45] Date of Patent: Jul. 8, 1986

[54] LATERAL SEALER DEVICE FOR VERTICAL PACKAGING MACHINE

[75] Inventor: Ichiro Takagaki, Ibaraki, Japan

[73] Assignee: Kabushiki Kaisha Sanwa Jidoki Seisakusho, Settsu, Japan

[21] Appl. No.: 647,668

[22] Filed: Sep. 6, 1984

[30] Foreign Application Priority Data

Sep. 16, 1983 [JP] Japan ..... 58-171760

[51] Int. Cl.[4] ..... B65B 51/30; B65B 9/12; B65B 9/20

[52] U.S. Cl. ..... 53/552

[58] Field of Search ..... 53/551, 555, 552, 554, 53/373, 451

[56] References Cited

U.S. PATENT DOCUMENTS

| | | | |
|---|---|---|---|
| 2,960,808 | 11/1960 | Pike | 53/551 X |
| 3,256,673 | 6/1966 | Tew et al. | 53/551 |
| 3,320,721 | 5/1967 | Murray | 53/552 |
| 3,599,387 | 8/1971 | James | 53/551 X |
| 3,685,250 | 8/1972 | Henry et al. | 53/551 |
| 4,040,237 | 8/1977 | O'Brien | 53/551 |
| 4,265,074 | 5/1981 | Reuter et al. | 53/389 X |

*Primary Examiner*—Horace M. Culver

*Attorney, Agent, or Firm*—Browdy and Neimark

[57] ABSTRACT

In a lateral sealer device for a vertical packaging machine, a strip of film is wound in a cylindrical form around the outer circumferential surface of a supply pipe by a film former, to form a bag-like package, both side edges of the resultant film are overlapped and heat-bonded together, and the bag-like package of film is then heat-bonded laterally at a predetermined pitch. In this sealer device, a sealer frame, which is provided with a pair of lateral sealer members which can toward and away from each other, is attached rotatably to a main frame of a packaging machine. The sealer frame is turned to a desired angle according to the packaging mode being employed and is fixed at a suitably-selected position, so that lateral heat-bonding of packages made of a strip of film can be done in a desired manner.

6 Claims, 10 Drawing Figures

LATERAL SEALER DEVICE FOR VERTICAL PACKAGING MACHINE

BACKGROUND OF THE INVENTION

1. Field of the Invention

This invention relates to a lateral sealer device for a vertical packaging machine which is provided with a lateral sealer which can be rotated and fixed at any desired angular position, and more particularly to a lateral sealer device for a vertical packaging machine which enables one packaging machine to seal articles in a suitable sealing mode selected as necessary from a variety of sealing modes, so as to meet various packaging requirements.

2. Description of the Prior Art

As is generally known, the packaging of articles using a strip of film 1 is done in one of four sealing modes, which include a back-seal mode in which each package has a vertical seal in the center of the rear surface thereof, a modified back-seal mode in which each package has a vertical seal positioned on the rear surface but some distance to the right or left from the center thereof, a triple-seal mode in which each package has a vertical seal along one edge thereof, and a quadruple-seal mode in which each package has vertical seals along two edges thereof.

Articles are packaged in a strip of film by a special packaging machine suited to the packaging mode in which the articles are sealed in one of the four ways described above.

Accordingly, different packaging machines for each of the various packaging modes are required. This increases the cost of the equipment and the area in which the packaging machines are installed.

SUMMARY OF THE INVENTION

An object of the present invention is to provide an excellent lateral-sealer device for a vertical packaging machine which is capable of solving these technical problems encountered in prior-art packaging machines, enables a single packaging machine to select any desired packaging mode as necessary, and which contributes greatly to fields using packaging machines in the distribution industry.

DESCRIPTION OF THE PREFERRED EMBODIMENT

Figure 1:
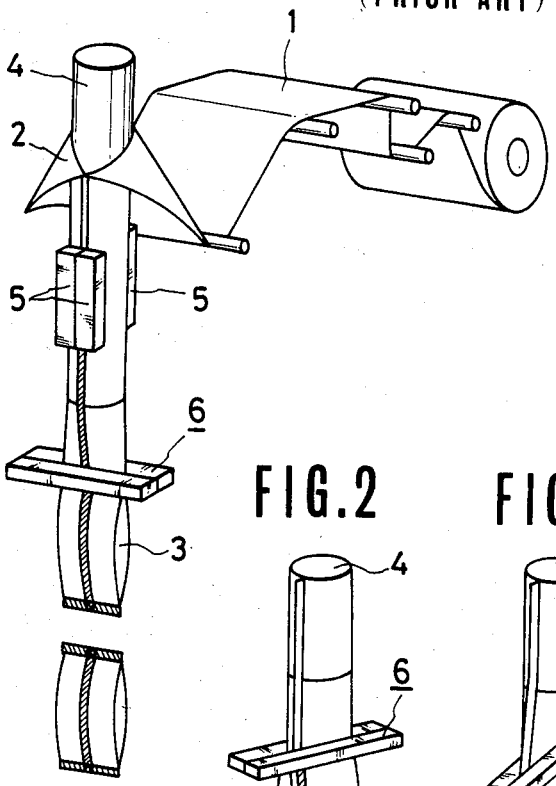
FIG. 1 (PRIOR ART)
FIGS. 1–4 are perspective views of various packaging modes.

An embodiment of the present invention will now be described with reference to FIG. 5 onward, as well as FIGS. 1–4.

Referring to the illustrated embodiment, reference numeral 1 denotes a packaging film in the shape of a strip of a predetermined width, which usually consists of an elongated strip of film rolled up into a cylindrical form.

The strip of film 1 is introduced at a desired tension into a film former 2 where it is formed into a cylindrical shape. A supply pipe 4 through which articles (not shown) being packaged are supplied into packages 3 is inserted through the film former 2, and the strip of film 1 is wound in a cylindrical form continuously around the outer circumferential surface of the supply pipe 4 by the film former 2.

This packaging method does not differ substantially from the existing packaging methods.

A vertical sealer 5 is provided so as to extend along the film former 2. The vertical sealer 5 overlaps the two edge portions of the cylindrically-formed strip of film 1, heat-bonds them together in a predetermined manner, and thereby shapes the strip of film 1 into a completed cylindrical form.

In this step, the strip of film 1 may be supplied intermittently at a pitch which is equal to the length of the vertical sealer 5, so that the edge portions thereof are heat-bonded successively by the vertical sealer 5. On the other hand, a packaging method in which the strip of film 1 is supplied continuously and the edge portions thereof are heat-bonded by the vertical sealer 5 as it moves reciprocatingly in the vertical direction can also be employed.

The edges of the strip of film 1 are thus heat-bonded in the same manner as in a conventional packaging machine, i.e., so-called "back-sealing" is done on the outer circumferential portion of the feed pipe 4.

A lateral sealer 6 is provided below the lower end of the supply pipe 4 and is designed to be rotated in the following manner, according to the packaging modes shown in FIGS. 1, 2, 3 and 4, and fixed in predetermined positions.

Figure 6:
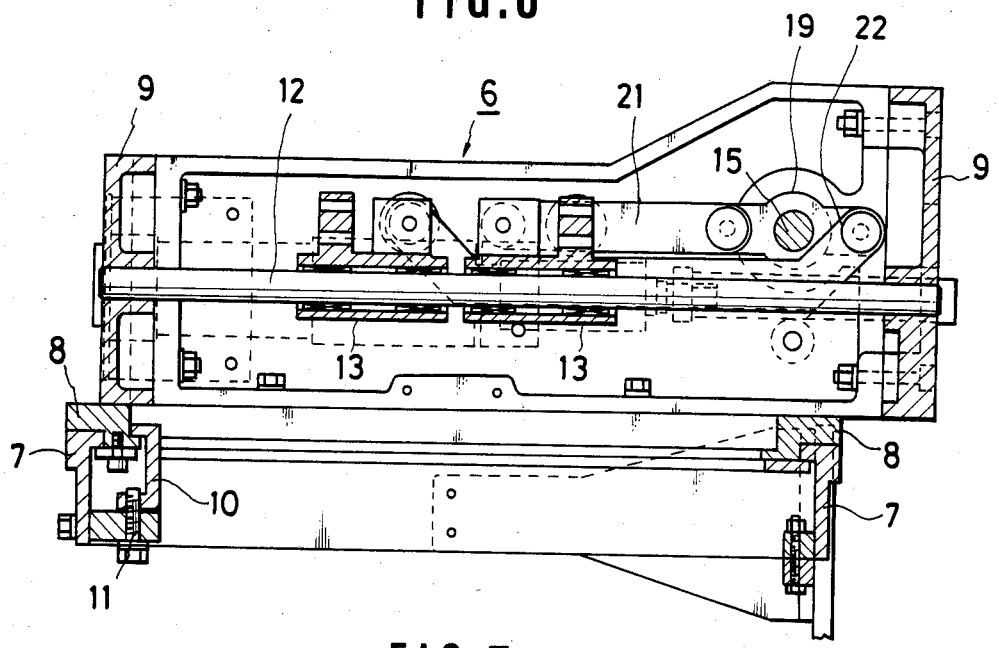
FIG. 6 is a longitudinally-sectioned front elevation of the sealer device.
Figure 7:
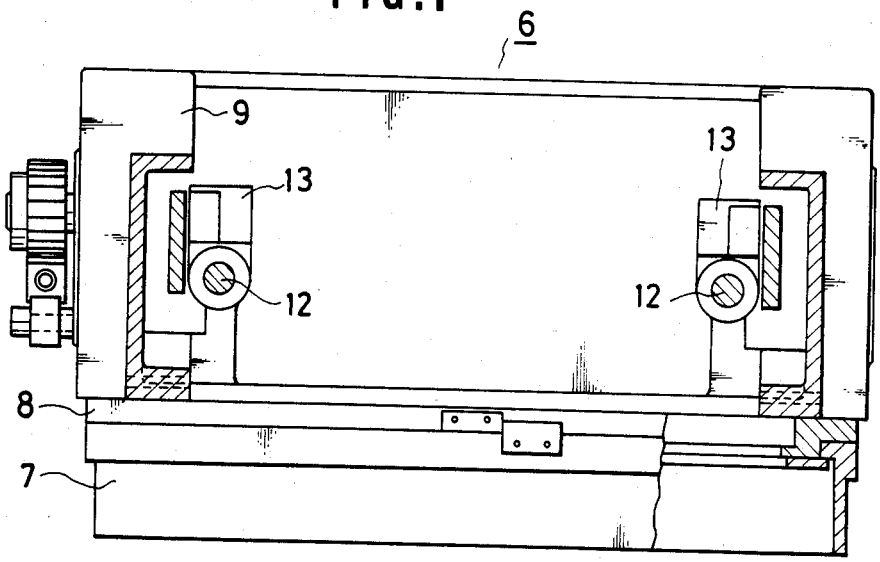
FIG. 7 is a side elevation of the sealer device.

As shown in FIGS. 6 and 7, the lateral sealer 6 is provided with a rotatable frame 8 supported on a fixed frame 7 projecting from a predetermined portion of the main frame of the packaging machine, and a lateral sealer frame 9 attached to the upper surface of the rotatable frame 8. The orientation of the lateral sealer can be varied, as shown in FIGS. 1–4, by the movement of the rotatable frame 8.

As shown in FIG. 6, a fixing member 10 engages with the rotatable frame 8 and is fastened to the fixed frame 7 by bolts 11, fixing the rotatable frame 8. When the fixing member 10 is loosened, the frame 8 becomes rotatable.

Figure 5:
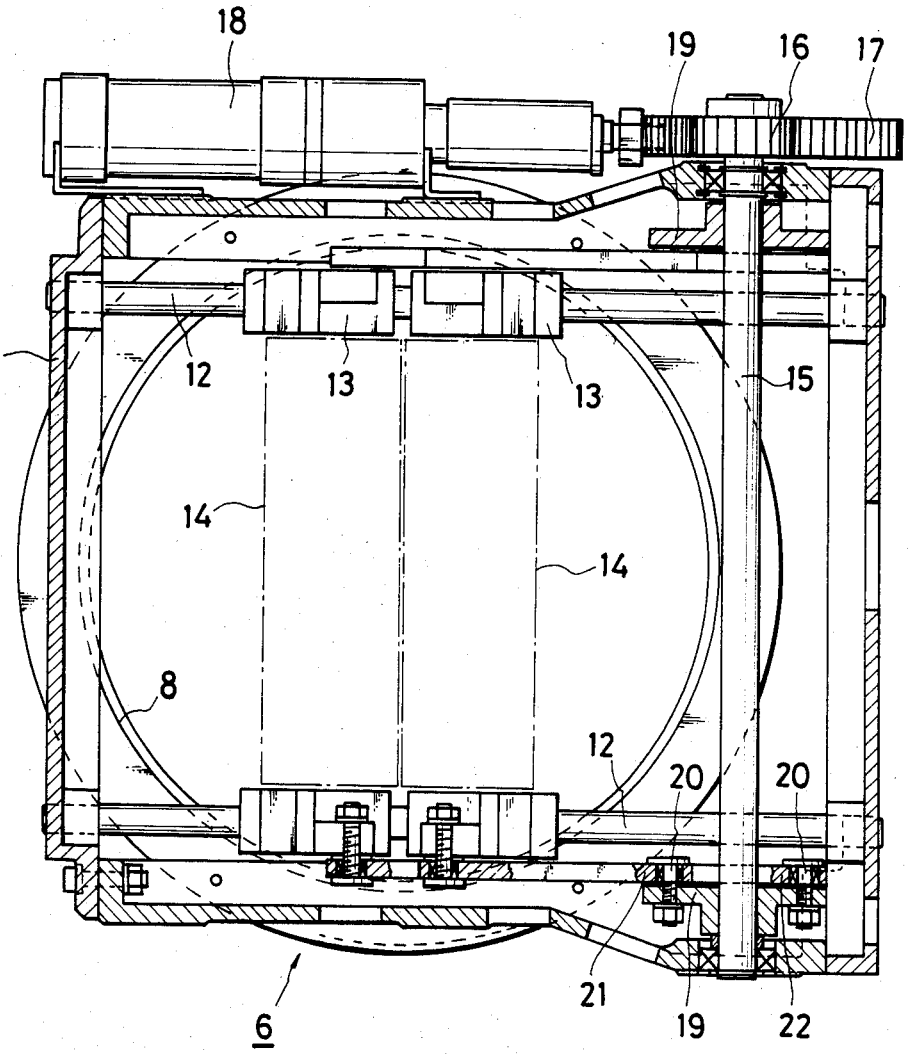
FIG. 5 is a horizontally-sectioned view of a lateral sealer device.

As shown in FIGS. 5 and 6, the lateral sealer frame 9 is provided with two parallel guide rods 12 which are supported thereon, and two slidable members 13 are fitted around each of the guide rods 12. Lateral sealer members 14 are provided between pairs of opposite slidable members 13, the two lateral sealer members 14 moving toward and away from each other to seal each package 3 made of the strip of film 1 laterally in a desired manner.

The length of the lateral sealer members 14 is determined to be equal to or greater than the width of the package 3 when flattened.

The movements of the lateral sealer members 14 toward and away from each other are done in accordance with the pivotal movements of a pivotable shaft 15 which is provided so as to extend parallel to the lateral sealer frame 9 and across a portion of each of the guide rods 12 on one side of the lateral sealer frame 9. A pinion 16 is attached to one end of the pivotable shaft 15, and meshes with a rack 17.

The rack 17 is moved reciprocatingly in a linear direction by a predetermined type of reciprocating actuator, consisting of a cylinder 18 or the like, so that the pivotable shaft 15 is rotated forward and backward alternately within a predetermined angular range, by the engagement of the rack 17 and pinion 16.

Figure 8:
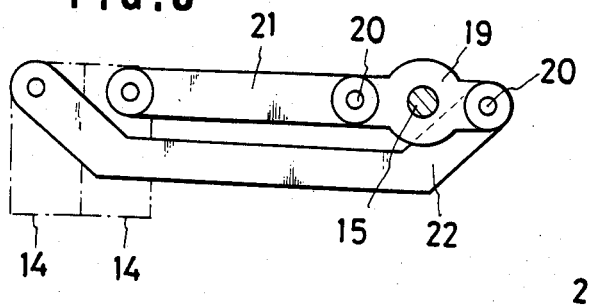
FIGS. 8 and 9 are side elevations of a crank link.
Figure 9:
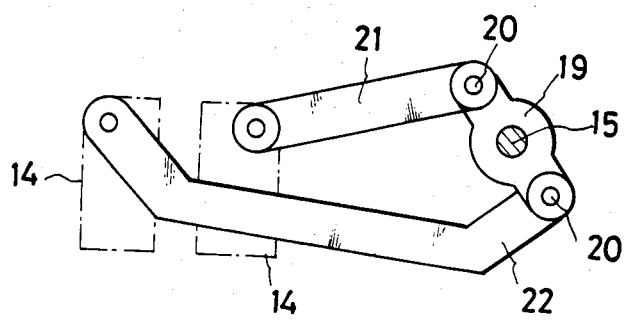

A crank 19 is attached to each end of the pivotable shaft 15, as shown in FIGS. 8 and 9, and two links 21, 22 are connected pivotably by pins 20 to opposite ends of each of the cranks 19.

One link 21 of the links 21, 22 is short and extends linearly, while the other 22 is long and curved. The inner end of each short link 21 is connected pivotably to the corresponding slidable member 13 to which the lateral sealer member 14 closer to the pivotable shaft 15 is attached, and the inner end of each long link 22 to the corresponding slidable member 13 to which the other lateral sealer member 14 is attached. Accordingly, when the pivotable shaft 15 is rotated forward and backward by the meshing of the rack 17 and pinion 16, when driven by the actuator 18, the slidable members 13 are slid toward and away from each other along the guide rods 12 by the cranks 19 and the short and long links 21, 22, to open and close the two opposed lateral sealer members 14 and seal the package 3 laterally.

Figure 10:
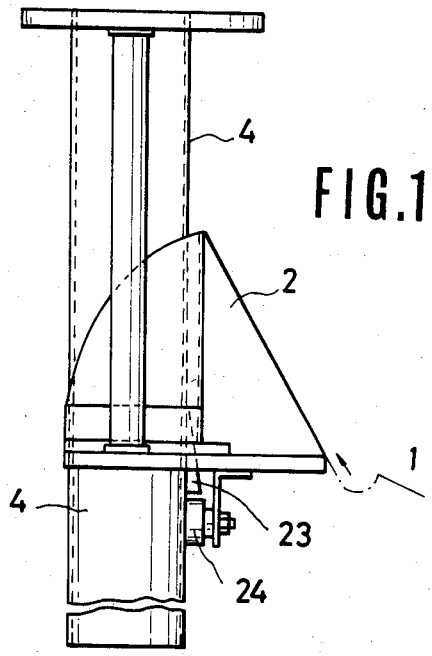
FIG. 10 is a side elevation of a film former.

A molding plate 23, which is attached to the supply pipe 4 and used for quadruple-sealing of packages, is provided removably on the rear side of the supply pipe 4, i.e., on the portion of the supply pipe 4 which is opposite to the vertical seal, as shown in FIG. 10. A pair of molding seal rollers 24 are provided in an opposed relationship either side of the molding plate 23. Part of the film which has been curved into a cylinder on the outer circumferential surface of the supply pipe 4 so that its edges meet, i.e., a portion of the cylindrically-formed film which is on the opposite side of sealed portion on the back of the package, is bulged outward by the molding plate 23. This bulged portion is compressed and heat-bonded by the molding seal rollers 24. The bulge in the package 3, as well as the back portion and both edges thereof, are sealed, i.e., quadruple-sealing of the packages 3 is done in this manner.

In order to package articles in the standard back-seal mode shown in FIG. 1, using the lateral sealer 6 of this construction, the lateral sealer 6 is set so that the lateral sealer members thereof extend at right angles to the direction in which the strip of film 1 moves along the supply pipe 4, i.e., horizontally in the lateral direction. The articles are then packaged by the lateral sealer 6 and the vertical sealer.

When packaging articles in the modified back-sealing mode in which the back seal of a package 3 is offset slightly to the right or left from the center of the rear surface thereof, the fixing member 10 is loosened, as previously mentioned, and the rotatable frame 8 is rotated far enough to correspond to the distance by which the seal on the rear surface of the package is offset from the center thereof. The fixing member 10 is then secured to fix the rotatable frame 8. The packaging of articles in the modified back-seal mode can then be carried out easily.

Figure 2:
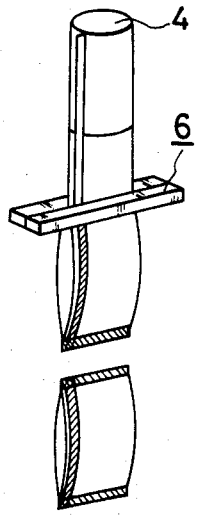

In this package-sealing operation, the lateral sealer is displaced through a desired angle with respect to the axis of the path along which the strip of film 1 is supplied, as shown in FIG. 2.

Figure 3:
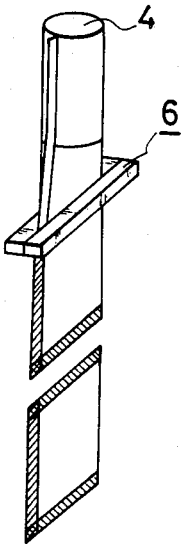

When packaging articles in the triple-seal mode shown in FIG. 3, the lateral sealer is rotated further in the above manner and is set at a position which is 90° from the position in which the package-sealing operation is done in the standard back-seal mode.

When packaging articles in the standard back-seal mode, modified back-seal mode and triple-seal mode, the molding plate 23 is not attached to the rear surface of the supply pipe 4.

Figure 4:
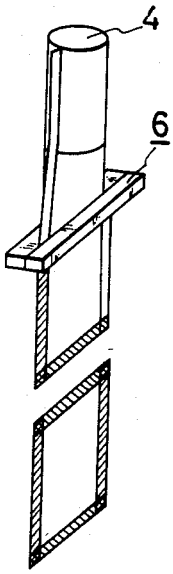

In order to provide quadruple-seal packaging using the same packaging machine, the molding plate may be attached to the rear surface of the supply pipe 4, in accordance with the quadruple-seal system shown in FIG. 4.

(Effect of the Invention)

According to the present invention described above, a lateral sealer is so arranged that it can be rotated to any desired angle about an axis extending in the direction in which a strip of film is supplied. When the lateral sealer is rotated and the angle thereof is regulated so that it is set at a suitable position, in accordance with the packaging mode being employed, the orientation thereof can be varied in four ways, enabling the packaging of articles by one packaging machine in four different modes, i.e., a back-seal mode, a modified back-seal mode, a triple-seal mode, and a quadruple-seal mode, so that any of these packaging modes can be selected as required. The construction and operation of the lateral sealer device according to the present invention are very simple, so that the device can be used very easily.

What is claimed is:

1. A lateral sealer device for sealing four sides of a package in a vertical packaging machine, wherein a strip of film is wound cylindrically around the outer circumferential surface of a supply pipe by a film former so that it is formed into the shape of a bag, both side edges of the resultant film being overlapped and heat-sealed together at a position along one side of the supply pipe, the resultant film being also heat-bonded in the lateral direction to complete a packaging operation, comprising:

a lateral sealer frame provided rotatably with respect to a main frame of said packaging machine, a pair of lateral sealer members provided on said lateral sealer frame so that said lateral sealer members can be slid toward and away from each other, said lateral sealer frame being rotatable to any desired angle and securable at a suitably-selected position, moding plate means, removably attached to a diametrically opposite side of said supply pipe, for outwardly bulging a portion of said package, said molding plate means being located above said lateral sealer frame, and a pair of sealing rollers disposed below said molding plate means and above said lateral sealer frame, said pair of rollers compressing and vertically heat-bonding the bulged portion, whereby after the bulged portion is sealed, two sides of the upper and lower portion of the package are sealed by said lateral sealer frame.

2. The lateral sealer device for a vertical packaging machine according to claim 1, wherein said lateral sealer frame can be attached rotatably or immovably to said main frame by screws.

3. The lateral sealer device for a vertical packaging machine according to claim 1, wherein said lateral sealer frame is attached the upper surface of a rotatable frame.

4. The lateral sealer device for a vertical packaging machine according to claim 1, wherein said lateral sealer frame is provided with a pair of guide rods with a pair of slidable members mounted on each of said guide rods, and lateral sealer members are connected to opposite slidable members.

5. The lateral sealer device for a vertical packaging machine according to claim 4, wherein links engaging with said slidable members are connected to reciprocating members.

6. The lateral sealer device for a vertical packaging machine according to claim 5, wherein said reciprocating members are crank-link mechanisms connected to an actuator.

* * * * *